US005555849A

United States Patent [19]

Wiechard et al.

[11] Patent Number: 5,555,849

[45] Date of Patent: Sep. 17, 1996

[54] GAS TEMPERATURE CONTROL SYSTEM FOR CATALYTIC REDUCTION OF NITROGEN OXIDE EMISSIONS

[75] Inventors: Robert N. Wiechard, Granby, Conn.; John M. Banas, Warren, Mass.; Richard D. Brown, Newington, Conn.

[73] Assignee: Combustion Engineering, Inc., Windsor, Conn.

[21] Appl. No.: 362,792

[22] Filed: Dec. 22, 1994

[51] Int. Cl.[6] ..... B09B 3/00; F22B 1/00

[52] U.S. Cl. ..... 122/4 D; 110/345; 422/173

[58] Field of Search ..... 122/4 D, 7 R, 122/20 B; 110/345, 348; 422/173

[56] References Cited

U.S. PATENT DOCUMENTS

| | | | |
|---|---|---|---|
| 3,818,872 | 7/1974 | Clayton, Jr. et al. | 122/451 X |
| 4,160,009 | 7/1979 | Hamabe | 122/4 D X |

FOREIGN PATENT DOCUMENTS

| | | | |
|---|---|---|---|
| 104022 | 7/1982 | Japan | 110/345 |
| 2040414 | 8/1980 | United Kingdom | 122/20 B |

*Primary Examiner*—Henry A. Bennett
*Assistant Examiner*—Susanne C. Tinker
*Attorney, Agent, or Firm*—Chilton, Alix & Van Kirk

[57] ABSTRACT

In order to maintain the flue gas temperature from a steam generator up to the temperature required for a $NO_x$ catalytic reactor during low load operations, the flow of feedwater through the steam generator economizer is controlled to control the degree to which the flue gas is cooled as it passes over the economizer heat exchange surface. More specifically, an economizer bypass line is provided and the flow of feedwater during low load operations through the bypass line and the economizer is regulated to maintain a desired flue gas temperature to the catalytic reactor. As the flue gas temperature changes with load, the flow through the economizer and bypass line is modulated to maintain a proper temperature. At full or near full load, the bypass line is fully closed.

2 Claims, 3 Drawing Sheets

GAS TEMPERATURE CONTROL SYSTEM FOR CATALYTIC REDUCTION OF NITROGEN OXIDE EMISSIONS

BACKGROUND OF THE INVENTION

The present invention relates to the catalytic reduction of nitrogen oxide emissions from fossil fueled power plants and more particularly to the control of the flue gas temperature entering the catalytic reactor during low load operation.

Three classes of emissions from fuel-burning processes are judged significant from an air quality standpoint. These are particulate matter, sulfur oxides and nitrogen oxides. Historically, the particulate matter received the greatest attention. This was then followed by the sulfur oxides because of the possible health effects and from its potential to damage vegetation and property. However, in recent years, the oxides of nitrogen have become of increasing concern because they participate in complex chemical reactions that lead to the formation of photo-chemical smog. Also, both the sulfur oxides and nitrogen oxides have been implicated as precursors to acid rain.

The reduction of nitrogen oxide emissions has taken two tacks, in-furnace control and post-combustion control. The in-furnace control involves such techniques as gas recirculation, low excess air firing, concentric tangential firing and overfire air. The post-combustion control primarily involves a reductant and catalyst to reduce nitrogen oxides to nitrogen gas and water vapor.

One particular system for the catalytic reduction of nitrogen oxides ($NO_x$) is referred to as selective catalytic reduction. This uses a catalyst and a reductant, ammonia gas to dissociate $NO_x$ to nitrogen gas and water according to the following reactions:

$$4NO+4NH_3+O_2 \rightarrow 4N_2+6H_2O$$

$$'bNO_2+4NH_3+O_2 \rightarrow 3N_2+6H_2O$$

Since $NO_x$ is approximately 95 percent NO, the first reaction dominates.

The ideal operating temperature range for selective catalytic reduction is generally from 300° to 400° C. (572° to 752° F.). When operating conditions fall much below 300° C., the potential for ammonium bisulfate formation and sulfur trioxide deposits on the catalyst surface increases. This can cause permanent catalyst activity loss. Above 400° C., ammonia gas may dissociate reducing the effectiveness of the process. If temperatures were to exceed about 450° C. (842° F.), the catalyst activity might be permanently impaired due to sintering.

The catalytic reaction chamber is typically located in the flue gas stream between the outlet from the economizer section and the flue gas inlet to the air preheater. This normally provides a flue gas temperature to the catalytic reactor within the above-noted operating conditions. Insufficient gas temperature occurs during low load operation.

SUMMARY OF THE INVENTION

The objective of the present invention is to control the temperature of the power plant flue gas entering a $NO_x$ catalytic reactor to produce the maximum flue gas $NO_x$ reduction. More specifically, the invention involves the control of the flue gas temperature exiting the power plant economizer and entering the catalytic reactor by controlling the water flow through the economizer and thereby controlling the degree to which the flue gas is cooled as it passes over the economizer surface.

DESCRIPTION OF THE PREFERRED EMBODIMENTS

Figure 1:
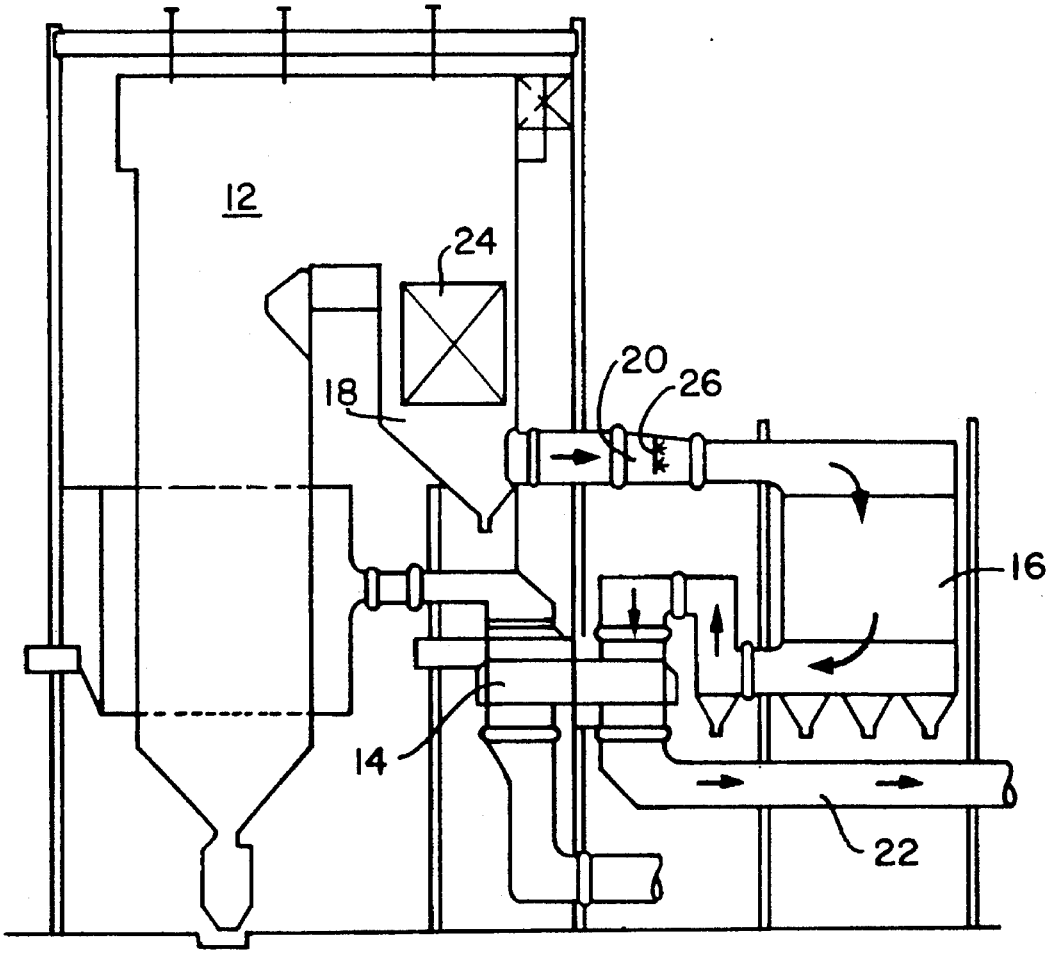
FIG. 1 is a diagram of a steam generator illustrating the catalytic reactor and the economizer heat exchange surface involved in the present invention.

FIG. 1 is an illustration of a typical steam generator 12 including an air preheater 14 and an $NO_x$ catalytic reactor 16. The flue gas from the steam generator flows through the back-pass 18, out through the duct 20 into the $NO_x$ catalytic reactor 16 and then through the air preheater 14 to the duct 22. From duct 22, the flue gas normally goes to a sulfur oxide removal system before discharge to the atmosphere.

In the back-pass 18 of the steam generator 12 is the conventional economizer heat exchange surface 24. The economizer transfers heat from the flue gas to the feedwater. The flue gas then flows into duct 20 where the ammonia gas is injected at 26 for reaction in the catalytic reactor 16.

During low load operation, the cold or relatively cool water in the steam generator circuit and particularly the cold feedwater in the economizer will result in a flue gas output with a significantly reduced temperature. Up to about 50% of full load, and when there is full flow through the economizer, this temperature will be insufficient to effectively operate the catalytic converter.

Figure 2:
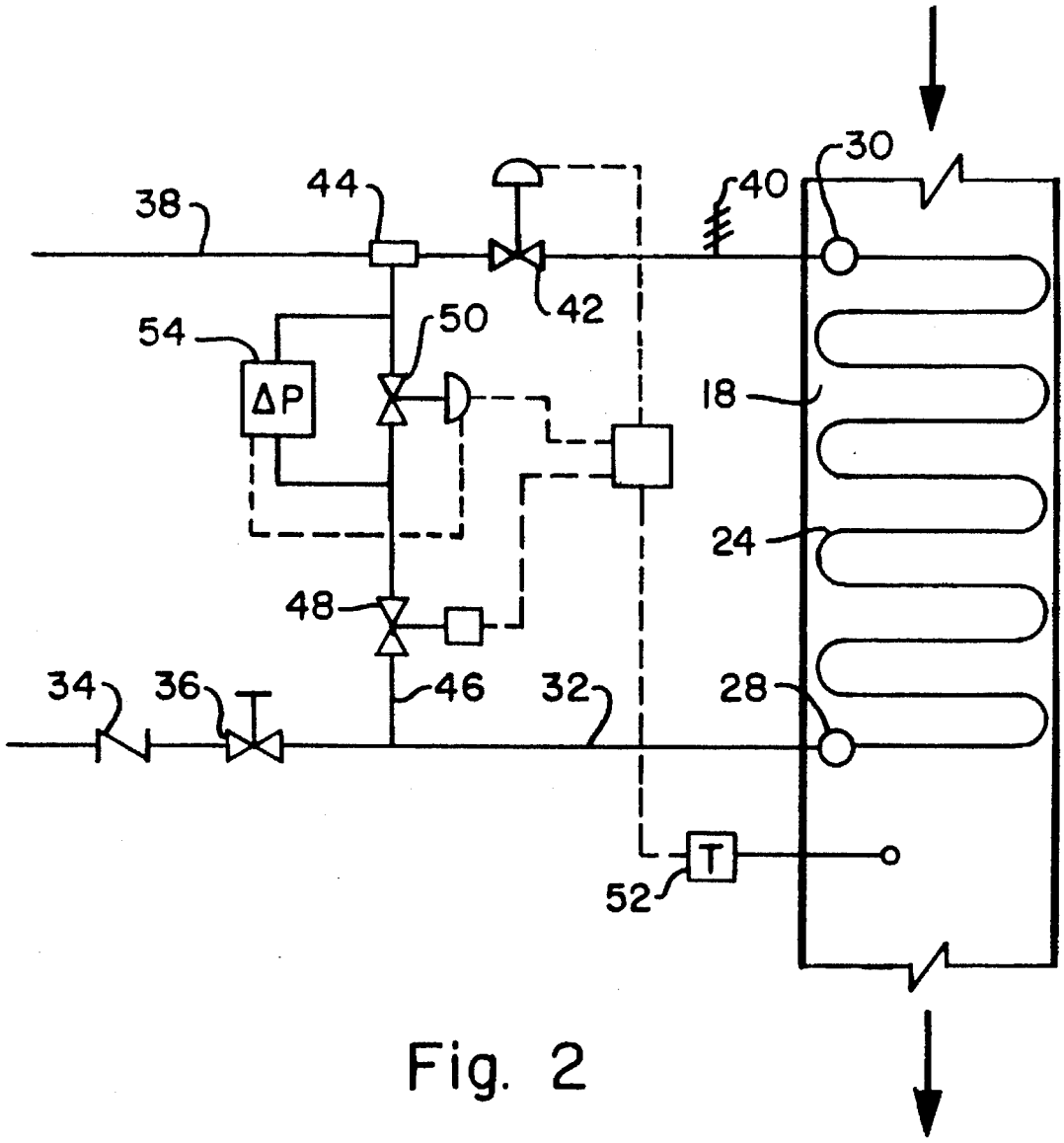
FIG. 2 is a flow diagram illustrating the arrangement for the economizer water flow control to control the flue gas exit temperature from the economizer section of the steam generator.

Turning now to FIG. 2, which illustrates the gas temperature control system of the present invention, the back pass 18 and the economizer 24 are illustrated. The economizer includes the inlet header 28 and the outlet header 30. Connected to the inlet header 28 is the feedwater line 32 which has a check valve 34 and a feed stop valve 36. Connected to the outlet header 30 is the outlet line 38 including the relief valve 40, the economizer outlet control valve 42 and the mixing device 44. Connected between the feedwater line 32 and the mixing device 44 in the economizer outlet line 38 is the bypass line 46 which has a bypass block valve 48 and a bypass control valve 50.

When the temperature of the flue gas leaving the economizer and entering the catalytic reactor as measured at 52 is too low, such as during loads less than about 50%, the bypass line block valve 48 is fully opened and the bypass line control valve 50 is positioned to maintain a desired flue gas temperature. When the bypass control valve 50 has been fully opened and the flue gas temperature needs to be increased further, the economizer outlet control valve 42 will start to close to further reduce the water flow through the economizer.

The economizer outlet control valve 42 must have an adequate pressure drop to prevent the water passing through the bypass line 46 from flowing in the reverse direction through the economizer outlet control valve and into the economizer. This is accomplished by maintaining an adequate pressure drop across the economizer bypass control valve 50. By this means, the pressure drop across the economizer outlet control valve 42 will be adequate to prevent reverse flow. Therefore, the bypass control valve 50 is preferentially controlled by the pressure drop across this valve 50 as measured at 54.

At the junction of the water bypassing the economizer and the fluid leaving the economizer, which may be steam, the flows are mixed at 44 to assure that any steam is condensed and that the mixture is water. Therefore, the mixture can take the normal economizer outlet water path to the steam drum and avoid the need for a separate steam line to the drum when the economizer is steaming.

Figure 3:
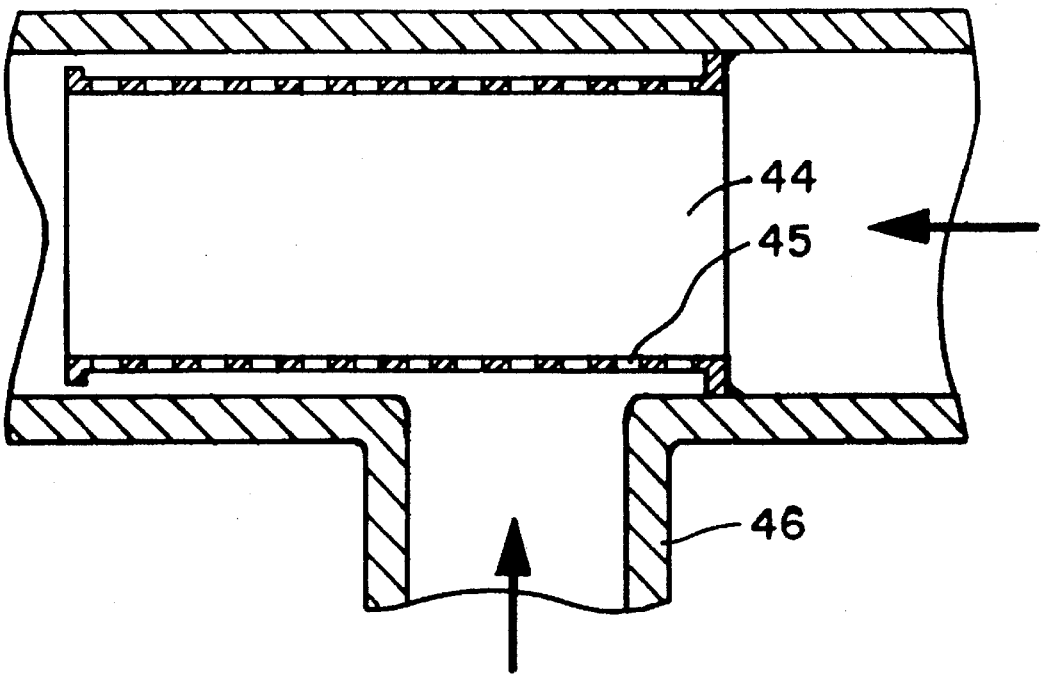
FIG. 3 shows the cross-section of a device for mixing the economizer and economizer bypass flows.

The details of the mixing device 44 are shown in FIG. 3. This is a modified desuperheater/thermal sleeve type of mixing device where the cooler bypass water from line 46 is introduced into the annulus around the thermal sleeve 45 while the hotter fluid from the economizer is introduced into the center.

In the event that the bypass block valve 48 or bypass control valve 50, the economizer outlet control valve 42 and the feed stop valve 36 were to be closed at the same time, the pressure relief valve 40 is provided.

To avoid rapid steam generation in the economizer during low load operation when load is being increased, water must be introduced slowly to the economizer. For example, the economizer outlet control valve is initially closed and the bypass valve is open. As load increases, the gas temperature leaving the economizer increases until the set temperature, for example about 370° C. (698° F.), is achieved. As this point is reached, the fluid inside the economizer will be steam and tube metal temperature will be about 370° C. (698° F.). As water is introduced to the economizer, it will flash to steam as the heat of the tubes is absorbed by the water. Water temperature will increase from about 188° C. (370° F.) to saturated steam at about 260° C. (500° F.) to superheated steam at about 370° C. (698° F.). Therefore, water will be introduced to the economizer at a rate that will not result in any steam going to the drum through the economizer links to the drum.

An example of one scheme for controlling the system begins with the economizer bypass block valve 48 and bypass control valve 50 being fully opened while the economizer outlet control valve 42 is closed. Therefore, the total flow is through the bypass line 46. As load increases and the gas temperature measured at 52 reaches the desired temperature of about 370° C. (698° F.), the bypass control valve 50 is modulated to achieve a fixed pressure drop across the valve 50 as measured at 54. The economizer outlet control valve 42 is then opened and modulated to control the gas temperature 52 leaving the economizer 24 at the desired level. When the economizer outlet control valve 42 is fully open, the bypass control valve 50 is modulated to control gas temperature. When the bypass control valve 50 becomes fully closed as the gas temperature increases above the desired level, perhaps 370° C. (698° F.), the bypass block valve 48 may be closed. The reverse of this whole operation would be followed when reducing load below about 50% in order to maintain the gas temperature to the catalytic reactor. It should be noted that all of these specific temperatures are by way of example only and will vary for any specific installation.

We claim:

1. A method of operating a steam generator process which generates a flue gas stream and in which an economizer heat exchanger is located in a flue gas pass of said steam generator for the transfer of heat from said flue gas stream to a feedwater stream in said economizer heat exchange and including a bypass circuit for said feedwater stream around said economizer heat exchanger, and further including a catalytic process located in said flue gas stream downstream of said economizer heat exchanger for reducing nitrogen oxides comprising controlling the temperature of the flue gas stream flowing from said flue gas pass to said catalytic process during low load operations including the steps of:

a. monitoring said flue gas stream temperature downstream of said economizer heat exchanger to determine when said temperature is less than a desired minimum level for said catalytic process;

b. at least partially opening said bypass circuit whereby at least some of said feedwater flows through said bypass circuit when said temperature is less than said desired minimum level; and c. modulating said feedwater flow through said bypass circuit to maintain a desired flue gas stream temperature.

2. A method as recited in claim 1 and further including the step of at least partially closing said economizer heat exchanger to feedwater flow when said temperature is less than said desired minimum level and modulating said feedwater flow through said economizer heat exchanger in conjunction with modulating said feedwater flow through said bypass circuit to maintain said desired flue gas temperature.

* * * * *